US006658228B2

(12) United States Patent
Wada

(10) Patent No.: US 6,658,228 B2
(45) Date of Patent: Dec. 2, 2003

(54) IMAGE FORMING APPARATUS FOR TRANSFERRING TONER IN A DEVELOPING UNIT

(75) Inventor: Hidekatsu Wada, Yachiyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/093,966

(22) Filed: Mar. 11, 2002

(65) Prior Publication Data

US 2003/0170051 A1 Sep. 11, 2003

(51) Int. Cl.[7] ..... G03G 15/09
(52) U.S. Cl. ..... 399/272; 399/273
(58) Field of Search ..... 399/267, 272–276

(56) References Cited

U.S. PATENT DOCUMENTS 6,308,037 B1 * 10/2001 Yamashita ..... 399/272

FOREIGN PATENT DOCUMENTS

JP 9-230700 9/1997

* cited by examiner

*Primary Examiner*—William J. Royer
(74) *Attorney, Agent, or Firm*—Foley & Lardner

(57) ABSTRACT

An image forming apparatus includes a housing, a toner hopper, a toner supply source, a magnetic roller, a development sleeve, a doctor blade, an agitator, a rotation arm provided in the agitator, a spoon formed on the tip of the rotation arm, a toner shelf arranged immediately below the development sleeve, a developer returning member provided between the doctor blade and the toner hopper, and a weir for guiding the toner and magnetic carrier cut and removed when the developer returning member returns the toner to the toner shelf. The weir has a top portion equal to or higher than the spoon surface when the rotation arm is horizontal. A space for passing through toner is formed between the weir and the developer returning member.

8 Claims, 3 Drawing Sheets

IMAGE FORMING APPARATUS FOR TRANSFERRING TONER IN A DEVELOPING UNIT

BACKGROUND OF THE INVENTION

The present invention relates to an image forming apparatus including an electrophotographic copying machine or a laser-beam printer. The present invention is particularly concerned with the improvement of a developing unit for developing an electrostatic latent image by supplying toner to the electrostatic latent image.

As a developing unit carrying out an electrophotographic process to be installed in an image forming apparatus, a two-component developing unit and a single-component developing unit are known. The two-component developing unit uses toner and carrier to develop an image, whereas the single-component developing unit uses toner alone.

In the two-component developing unit, development is performed by allowing toner particles to adhere to carrier particles, transferring the carrier particles with the toner to the outer periphery of a development sleeve to form a developer layer thereon, bringing the developer layer into contact with the surface of a photosensitive drum, removing the toner particles from the carrier particles by the Coulomb force of the electrostatic latent image previously formed on the photosensitive drum, thereby attaching the toner particles to the electrostatic latent image.

In the single-component developing unit, development is performed by forming a thin film of toner particles alone on the outer periphery of a development sleeve, and arranging a photosensitive drum to face the development sleeve at a predetermined interval, thereby supplying toner particles selectively to an electrostatic latent image previously formed on the photosensitive drum to attach the toner to the electrostatic latent image.

Recently, Jpn. Pat. Appln. KOKOKU Publication Nos. 7-40156 and 7-43554 have proposed a "quasi two-component developing unit" using a small amount of magnetic carrier. The quasi two-component developing unit basically belongs to the class of single-component developing units. In the quasi two-component developing unit, development is performed by attaching a starting material containing toner and a small amount of magnetic carrier to a development sleeve before a developing process is initiated and then supplying the toner alone to the development sleeve. Alternatively, a developer is known that comprises a magnetic toner and a small amount of magnetic carrier, the developer being supplied in the vicinity of a developing roller to supply only the magnetic toner to the development sleeve.

In the two-component developing unit and the quasi two-component developing unit, a doctor blade is arranged near the development sleeve so as to face the peripheral surface thereof. Since the doctor blade cuts and removes excessive developer from the development sleeve, a developer layer (containing carrier and toner) can be formed with a predetermined thickness on the development sleeve.

In such a two-component developing unit, the developer cut and removed is properly returned to a toner hopper, where the carrier and the toner are agitated and so mixed up and again supplied to the developing roller (the development sleeve).

However, in the quasi two-component developing unit, the developer cut and removed is returned sequentially through a toner hopper, a toner table (stepped portion of a housing) and a developing roller. This means that the magnetic carrier is returned together with the toner to the toner hopper when the developer is returned to the toner hopper. As a result, shortage of magnetic carrier locally occurs in the vicinity of the developing roller. Since the amount of magnetic carrier is originally low in the quasi two-component developing unit, shortage of magnetic carrier occurs frequently. If the supply of magnetic carrier is insufficient, the concentration of toner present on the developing roller varies, producing an image of uneven density and a faintness, and fogging.

A conventional quasi two-component developing unit generally employs a vertical transfer system. Therefore, toner is supplied to the developing roller by simply being raised from a toner-stirring vessel. It is therefore difficult to maintain uniform toner concentration.

BRIEF SUMMARY OF THE INVENTION

An object of the present invention is to provide an image forming apparatus capable of maintaining a stable image quality for a long time without producing an image of uneven density, a faintness or fogging. Particularly, the present invention is directed to a developing unit for maintaining the toner supplied to a developing roller at a uniform concentration.

The image forming apparatus of the present invention comprises

- an image read-out section for reading out an image;
- a photosensitive drum for forming an electrostatic latent image corresponding to the image based on image data supplied from the image read-out section;
- a vertical transfer passage for transferring a transfer material upward to the photosensitive drum; and
- a developing unit arranged below the photosensitive drum for depositing the toner on the electrostatic latent image formed on the photosensitive drum with the assistance of a small amount of magnetic carrier.

The developing unit comprises

- a housing;
- a toner hopper, which is a part of the housing, for containing a toner;
- a toner supply source for supplying the toner to the toner hopper;
- a magnetic roller positioned above the toner hopper for imparting a magnetic field to the magnetic carrier;
- a development sleeve, covering the outer periphery of the magnetic roller, holding the magnetic carrier, allowing the magnetic carrier to adsorb the toner, rotating in the opposite direction to the rotation direction of the magnetic roller, thereby allowing the toner to transfer and adhere onto the electrostatic latent image formed on the photosensitive drum;
- a doctor blade arranged a slight distance from the development sleeve for cutting and removing excessively supplied toner from the development sleeve;
- an agitator arranged within the toner hopper for agitating and mixing the toner contained in the toner hopper;
- a rotation arm arranged in the agitator and rotated about a rotation center lower than a rotation center of the development sleeve;
- a spoon having a substantially flat spoon surface (bowl) at a tip of the rotation arm for scooping up the toner from the toner hopper when the spoon surface (bowl of the spoon) comes close to the development sleeve and transferring the toner;

a toner shelf, which is a part of the housing, arranged immediately under the development sleeve for holding the toner transferred by the spoon and for receiving the toner and the magnetic carrier cut and removed by the doctor blade;

a developer returning member, arranged between the doctor blade and the toner hopper, for preventing the toner and magnetic carrier cut and removed by the doctor blade from transferring to the toner hopper, guiding and returning the toner and magnetic carrier to the toner shelf; and a weir, arranged between the toner shelf and the toner hopper, having a top portion which is equal to or higher than the spoon surface (bowl of the spoon) in height when the rotation arm is horizontal and which defines a space between the top portion and the developer returning member for passing the toner to be transferred by the spoon, and guiding and returning the toner and magnetic carrier cut and removed when the developer returning member returns the toner to the development sleeve.

The top portion of the weir is desirably higher by up to 2.5 mm than the spoon surface (the bowl of the spoon) when the rotation arm is horizontal. This is because, as shown in FIG. 5, if the difference Δh in height between the top portion of the weir and the spoon surface (the bowl of the spoon) is lower than 0 (Δh<0), the concentration of the toner on the development sleeve becomes uneven. In particular, if the difference Δh in height is less than −1.2 mm (Δh<−1.2 mm), the concentration of toner on the development sleeve becomes significantly uneven, causing development defects. This phenomenon occurs in the region leftward of line E in FIG. 5.

On the other hand, if the difference Δh in height exceeds 2.5 mm (Δh>2.5 mm), the amount of toner supplied to the development sleeve decreases, producing a faint image. In particular, if the difference Δh in height exceeds 3 mm (Δh>3 mm), letters become too faint to read. This phenomenon occurs in the region rightward of line F in FIG. 5.

Furthermore, when the toner concentration on the development sleeve increases, letters become faint. In particular, when the toner has run out, the toner concentration exceeds 18 wt %, with the result that printing cannot be done properly because of faint streaking. This phenomenon occurs in the region above line G in FIG. 5.

According to the present invention, it is possible to suppress the supply of toner to the development sleeve so that the carrier/toner on the development sleeve can be charged more efficiently. Thus, the toner particles on the development sleeve are uniformly charged, with the result that uniform development can be achieved. Hence, it is possible to obtain stable images having no unevenness and faint streaking.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, preferred embodiments of the present invention will be explained with reference to the accompanying drawings.

Figure 1:
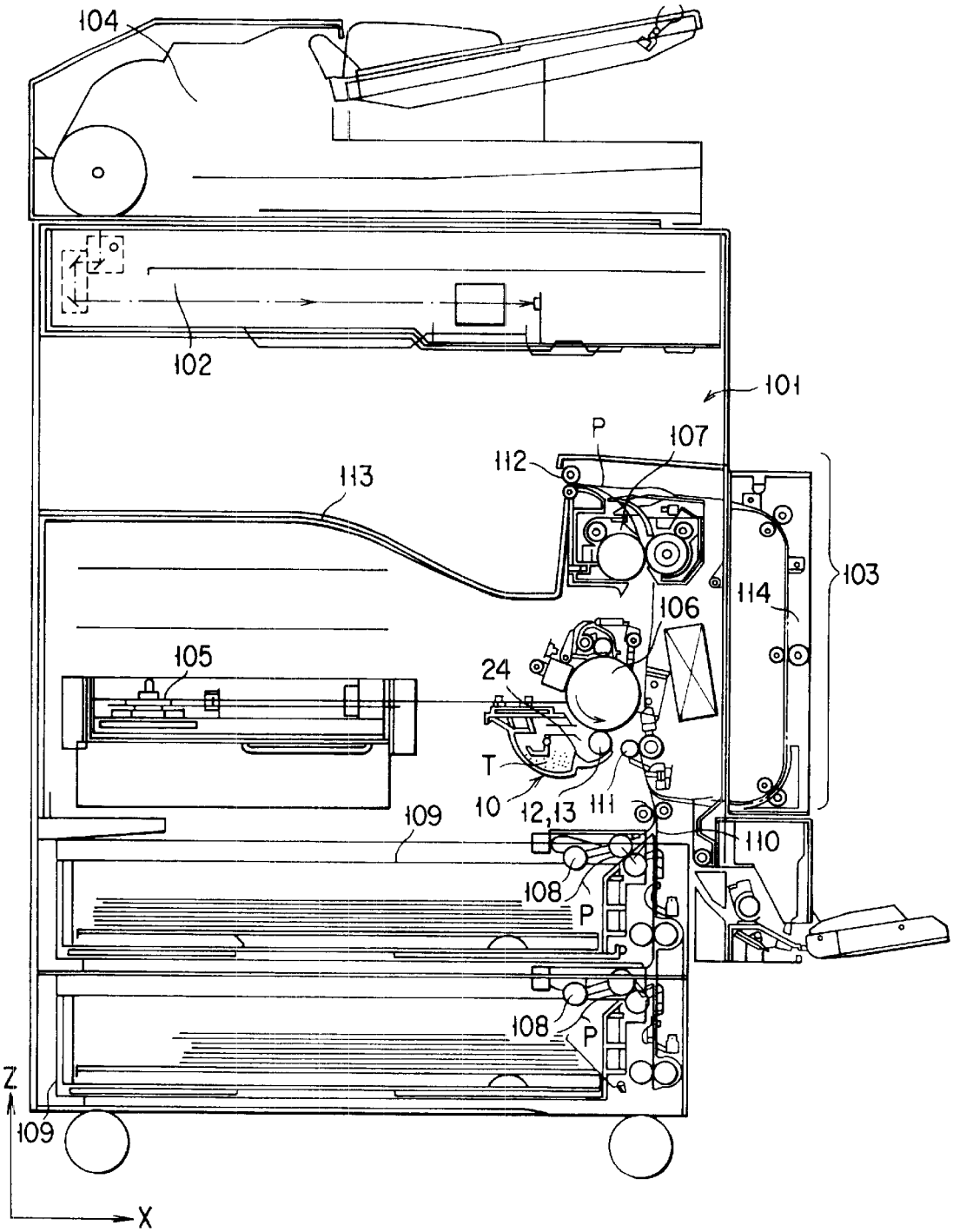
FIG. 1 is a perspective sectional view showing the entire schematic structure of an image forming apparatus according to an embodiment of the present invention.

As shown in FIG. 1, a digital copying machine 101 comprises a scanner 102 for reading image data of an original document as the variations of light and shade, thereby producing image signals, and an image forming section 103 for forming the images corresponding to the image signals supplied from the scanner 102 or an apparatus (not shown) arranged outside the copying machine. The scanner 102 is equipped with an auto draft feeder (ADF) 104 for feeding a sheet-form object (sheet) on which an image is to be printed. The ADF 104 feeds the sheet in synchronism with an image read-out operation by the scanner 102.

The image-forming section 103 comprises a light-exposure apparatus 105, a photosensitive drum 106, a developing unit 10, and a fixing unit 107. A laser beam corresponding to image data supplied from the scanner 102 or extraneous apparatus (not shown) is emitted from the light exposure apparatus 105 and applied on the photosensitive drum 106. The photosensitive drum 106 holds the image corresponding to the laser beam supplied from the light-exposure apparatus 105, as an electrostatic latent image.

The developing unit 10 has a developing roller and a toner hopper 14 for supplying toner to an electrostatic latent image on the photosensitive drum 106 and allowing the toner to adsorb to the electrostatic latent image. A transfer apparatus transfers a toner image, which has been developed by the developing unit 10 on the photosensitive drum 106, to a sheet of paper P. The fixing unit 107 heats and melts the transferred toner image and fixes it on the sheet P. Note that a two-sided paper feeder 114 is provided between the fixing unit 107 and a cassette 109, for turning over the sheet P.

Now, the operation of the digital copying machine 101 will be briefly described.

A sheet P is taken out from the cassette 109 by a pick—up roller 108, transferred along a vertical sheet transfer passage 110, and passed through the developing unit 10, the photosensitive drum 106, and the fixing unit 107, and discharged onto a discharge tray 113 via a discharge roller 112. Note that a reference numeral 111 in FIG. 1 indicates an aligning roller whose operation is controlled by a controller (not shown) The aligning roller 111 feeds the sheet P to a predetermined transfer position between the photosensitive drum 106 and the transfer apparatus with a predetermined timing.

When image data are supplied from the scanner 102 and the external apparatus, the photosensitive drum 106, which have been previously charged to a predetermined potential, is irradiated with a laser beam modified in intensity by the image data from the light-exposure apparatus 105. In this manner, the electrostatic latent image corresponding to the image to be reproduced is formed on the photosensitive drum 106.

When toner T is supplied from the developing unit 10 to the photosensitive drum 106 to form an electrostatic latent image. The toner T on the electrostatic latent image is transferred onto the sheet P by an electric field given by the transfer apparatus (not described). After the transfer, the toner T on the sheet P is heated and melted by the fixing unit 107 to be fixed on the sheet P. Subsequently, the sheet P is discharged by the discharge roller 112 onto the discharge tray 113 provided between the scanner 102 and the cassette 109.

Now, the developing unit 10 will be described more specifically with reference to FIGS. 2 to 4.

Figure 2:
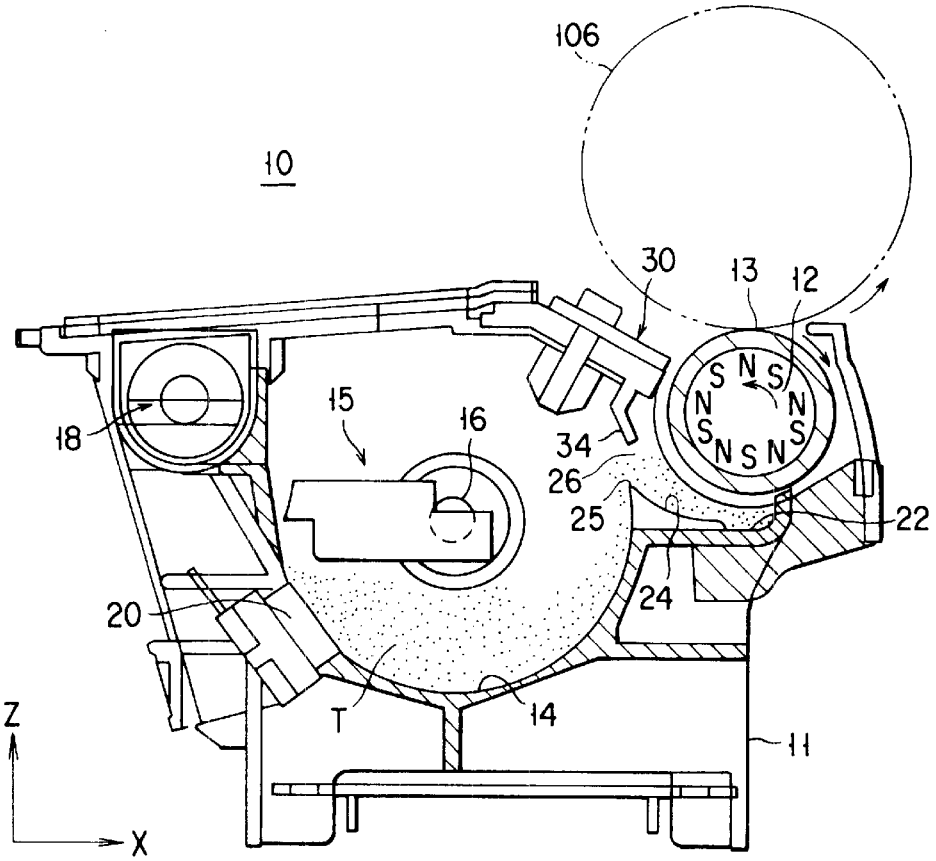
FIG. 2 is a perspective sectional view showing a developing unit of the image forming apparatus.

As shown in FIG. 2, the developing unit 10 comprises a housing 11, a developing roller (including a magnetic roller 12 and a development sleeve 13), a toner hopper 14, an agitator 15, a toner shelf 22, a weir 24, a toner cartridge holding portion 18, an original document detecting sensor 20, and a developer adjustment assembly 30 (including a doctor blade 32 and a developer returning member 34). The developing roller and the toner cartridge holding portion 18 are respectively arranged at the upper right and left of the toner hopper 14 interposed between them.

The developing roller is arranged at an opening portion of the housing 11. The developing roller comprises the magnetic roller 12 and the development sleeve 13 concentrically arranged. The magnetic roller 12 is arranged at the core portion and the development sleeve 13 is provided at the outer peripheral portion. The magnetic roller 12 and the development sleeve 13 are independently rotated in opposite directions to each other. The developing unit 10 is arranged such that the closest distance between the outer surface of the development sleeve 13 and the outer periphery of the photosensitive drum 106 is about 0.35 mm.

The development sleeve 13 of 20 mm in diameter is rotated at a speed of 254 mm/second. The rotation direction of the development sleeve 13 is the same as that of the photosensitive drum 106 at the position at which the development sleeve 13 faces the outer peripheral surface of the photosensitive drum 106 even if their rotation shafts rotate in opposite directions.

The magnetic roller 12 consists of, for example, 12 pairs of poles. N poles and S poles are alternately arranged at almost uniform intervals, as viewed from the direction perpendicular to the core shaft.

The magnetic force of each magnetic pole of the magnetic roller 12 is approximately 700 gauss as measured on the surface of the development sleeve 13. The magnetic roller 12 is rotated at a speed of, for example, 2000 rpm, in the opposite direction of the development sleeve 13.

A developer adjustment assembly 30 has a doctor blade 32, a developer-returning member 34, a bracket 31, and a fastening bolt 33. The developer returning member 34 and the bracket 31 are integrally formed into one body. The bracket 31 is aligned with the housing 11. The doctor blade 32 is stacked on the bracket 31. Finally, the fastening bolt 33 is engaged with a nut 11*a* arranged at the side close to the housing 11.

The doctor blade 32 is arranged near the outer peripheral surface of the development sleeve 13 so as to face it. The doctor blade 32 is arranged upstream of the position facing the photosensitive drum 106 in the rotation direction (clockwise direction in the figure) of the development sleeve 13. The doctor blade 32 regulates the thickness of the developer layer to a predetermined value, which is deposited on the outer peripheral surface of the development sleeve 13. To regulate the thickness as mentioned, the doctor blade 32 is arranged so as to keep the closest distance of 0.25 mm between the tip portion of the doctor blade 32 and the outer peripheral surface of the development sleeve 13. The doctor blade 32 cuts and removes excessive toner from the development sleeve 13.

The developer-returning member 34 is provided between the doctor blade 32 and the agitator 15. The developer—returning member 34 guides the removed toner toward the toner shelf 22 while preventing the toner cut and removed by the doctor blade 32 from entering the toner hopper 14. Note that the doctor blade 32 and the developer-returning member 34 are arranged so as not to interfere with the rotation of the tip (spoon 15*b*) of the agitator arm.

Figure 3:
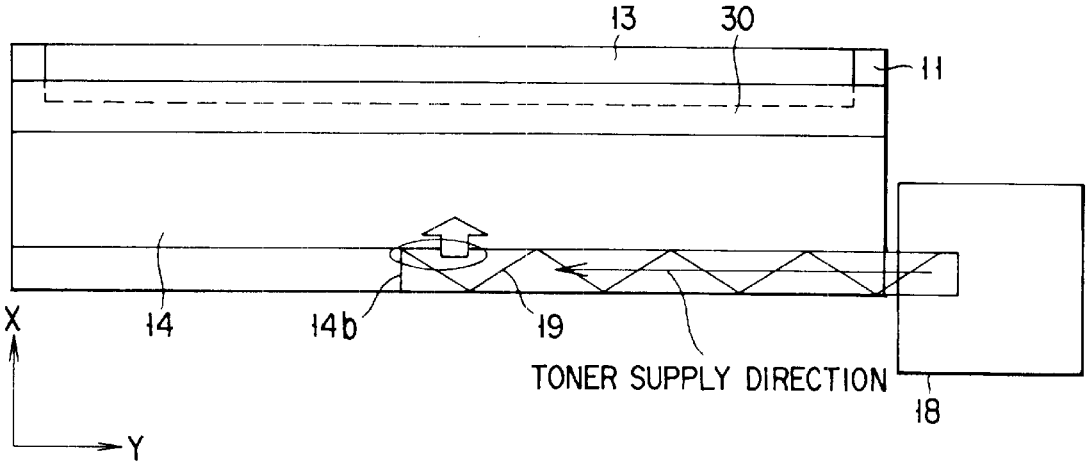
FIG. 3 is a schematic block view showing a toner supply portion of the developing unit.
Figure 4:
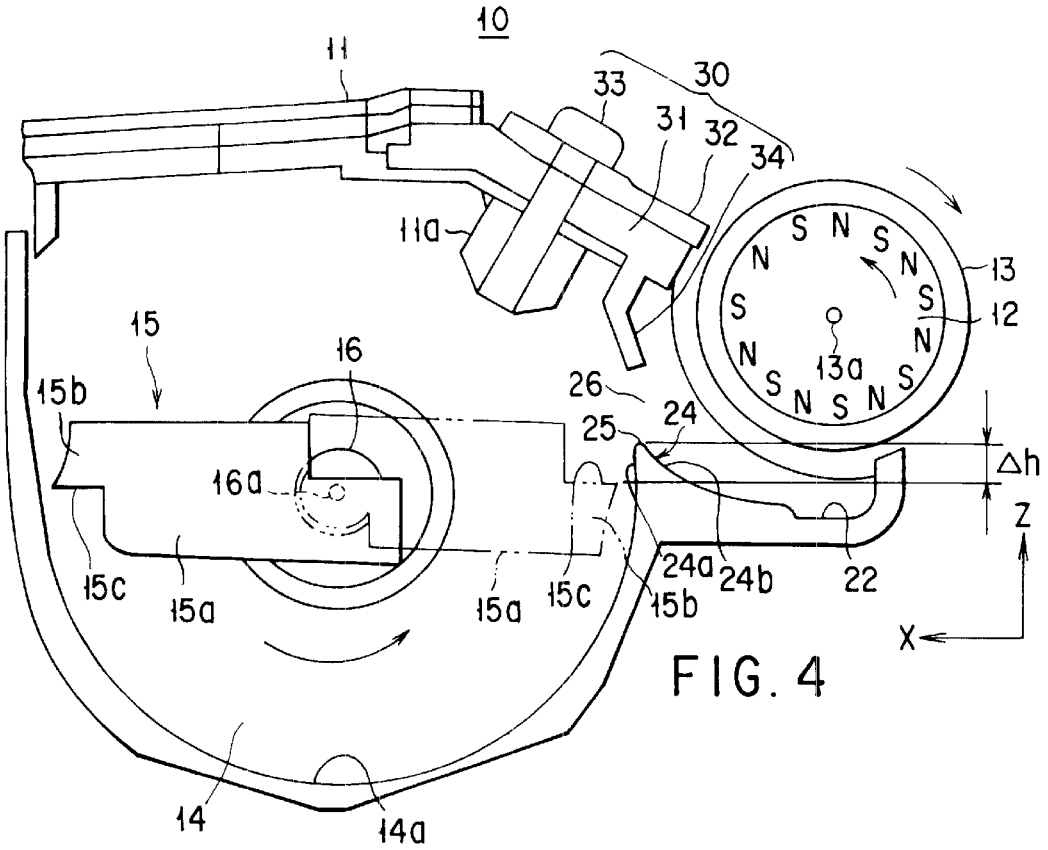
FIG. 4 is an enlarged perspective sectional view showing the developing unit according to the embodiment.

As shown in FIG. 3, a toner supply port 14*b* is formed in an appropriate position of the toner hopper 14. The toner supply port 14*b* communicates with a toner cartridge of the holding portion 18 via an auger conveyor 19. Toner T is supplied from the toner cartridge of the holding portion 18 to the toner hopper 14 by way of the auger conveyor 19 and the toner supply port 14*b*.

When supply of developer is initiated, a starting agent containing carrier and toner T mixed in advance is first supplied and then a developer containing only toner T is supplied. The original document detecting sensor 20 is attached at a proper position of the toner hopper 14 for detecting the amount of toner T within the toner hopper 14. As the toner, a magnetic toner is used which contains toner particles of 9 $\mu$m in average diameter and a magnetic material that imparts magnetic properties to the toner particles. As the carrier, an Mn—Mg (ferrite) based magnetic carrier is used which contains particles of 65 $\mu$m in average diameter.

The toner hopper 14 has a semi-cylindrical shape. The agitator 15 is provided in the toner hopper 14. The agitator 15 has an agitator arm 15*a* which is parallel to a rotation shaft (a Y-axis) of the development sleeve 13, extends in a radial direction crossing the Y axis at right angles and has a length slightly shorter than the radius (inner radius) of the toner hopper 14.

The agitator arm 15*a* is connected to and supported by a rotation driving shaft 16 and has a spoon 15*b* at the tip. The spoon 15*b* is formed such as a spatula by working the agitator arm 15*a* to the half in thickness. The spoon 15*b* has a spoon surface 15*c* for scooping up the toner T from the toner hopper 14.

The spoon surface 15*c* is substantially flat and parallel to the agitator arm 15*a* in the longitudinal direction. The spoon surface 15*c* is slightly shifted from the extension line of the rotation center 16*a* of the agitator arm 15*a*.

The agitator arm 15*a* is formed of a resin such as glass containing acrylonitrile butadiene styrene (ABS), polytetrafluoroethylene (PTFE), a tetrafluoroethyleneper fluoroalkylvinylether copolymer (PFA), tetrafluoroethylene-hexafluoropropylene copolymer (FEP), or polyetheretherketone (PEEK).

The rotation center 16*a* of the agitator arm 15*a* is located below the rotation center 13*a* of the development sleeve 13 on the Z-axis. In this embodiment, the agitator 15 is rotated in the same direction (counter clockwise, see FIG. 4) as that of the magnetic roller 12. A flexible sheet may be attached to the tip of the spoon 15*b* to supply toner T.

The toner hopper 14 and the toner shelf 22 are formed of a resin and integrally and continuously formed with the housing 11 and thus form parts of the housing 11. The weir 24 may be either an integrally formed part of the housing 11 or a discrete part detachably attached to the housing 11 (the toner shelf 22)

The toner shelf 22 formed between the toner hopper 14 and the development sleeve 13 is substantially flat and horizontal. The toner shelf 22, which is located immediately below the development sleeve 13 and extends along the shaft (Y axis) of the development sleeve 13 is slightly longer than the development sleeve 13. The length of the toner shelf 22 in the X-axis is equal to or shorter than the diameter of the development sleeve 13.

The weir 24 is formed between the toner shelf 22 and the toner hopper 14. The top portion 25 of the weir 24 is higher than the toner shelf 22. The top portion 25 of the weir is equal to or higher than the level of the spoon surface 15*c* when the agitator arm 15*a* of the agitator 15 becomes horizontal with the spoon surface 15*c* up. The top portion 25 may be higher up to 2.5 mm. In this embodiment, the top portion 25 of the weir 24 is set to be higher by about 1 mm than the spoon surface 15*c* when it is placed horizontally with the spoon surface 15*c* up. The top portion 25 of the weir 24 is set to be equal to or higher than the level of the rotation center 16*a* of the agitator arm 15*a*.

A front-edge slope 24*a* is formed at the front side (a side close to toner hopper 14) of the top portion 25 and smoothly continues to the inner wall surface 14*a* of the toner hopper 14. The rear side (a side close to the toner shelf 22) of the top portion 25 is a rear-edge slope 24*b* and smoothly continues to the toner shelf 22. The front-edge slope 24*a* is a curved surface having substantially the same curvature as that of the inner wall surface 14*a* of the toner hopper 14. The rear-edge slope 24*b* is a concave-form surface whose curvature (angle of inclination) is gradually reduced toward the toner shelf 22.

A space 26 is defined by the top portion 25 of the weir 24 and the developer-returning member 34. The toner T is transferred to the toner shelf 22 by way of the space 26. The weir 24 works in concert with the developer-returning member 34 to control the movement of the toner T. More specifically, the weir 24 and the developer-returning member 34 suppress the supply amount of toner to the toner shelf 22 and guide the toner and magnetic carrier cut and removed by the doctor blade 32 to the toner shelf 22. In this manner, the toner can be effectively returned to the development sleeve 13.

The developing roller is positioned immediately above the toner shelf 22. Immediately above the developing roller, a photosensitive drum 106 is positioned. The core portion of the developing roller is formed of a magnetic roller 12. The outer periphery of the developing roller is a development sleeve 13. The development sleeve 13 is concentrically formed with the magnetic roller 12 so as to cover the magnetic roller 12. The development sleeve 13 and the magnetic roller 12 are independently rotated by driving mechanisms (not shown)

The closest interval between the outer peripheral surface of the development sleeve 13 and the outer peripheral surface of the photosensitive drum 106 is set at about 0.35 mm. The rotation speed of the development sleeve 13 is 254 mm/second at a point at which the development sleeve 13 faces the outer peripheral surface of the photosensitive drum 106. The diameter of the development sleeve 13 is 20 mm.

The magnetic roller 12 has 12 pairs of N and S poles, which are alternately arranged around the developing roller circumference at uniform intervals in a sectional view perpendicular to the shaft 16.

The magnet force of each of the magnet poles of the magnetic roller 12 is about 700 gauss as measured at the surface of the development sleeve 13. The magnetic roller 12 is rotated at a speed of 2000 rpm in an opposite direction to the rotation direction of the development sleeve 13.

Toner T is scooped up by the spoon 15*b* of the agitator 15 from the toner hopper 14, raised over the top portion 25, slid down along the rear edge sloop 24*b* of the weir 24 and accumulated in the toner shelf 22. The toner T is transferred from the toner shelf 22 to the development sleeve 13 by means of adsorption and further transferred from the development sleeve 13 to the photosensitive drum 106 by means of adsorption.

The toner concentration varies depending upon the difference Δh in height between the top portion 25 of the weir 24 and the spoon surface 15*c*. The effect of the difference Δh upon the toner concentration will be explained with reference to FIG. 5.

The difference Δh in height is plotted on the horizontal axis when the agitator arm iSa is horizontal. The toner concentration (wt %) is plotted on the vertical axis. The correlation between the distance Δh and the toner concentration is checked and shown in FIG. 5.

Toner was supplied at a rate of 20 g/min from a toner cartridge of the holding portion 18 to the toner hopper 14 while the agitator arm 15*a* and the development sleeve 13 were rotated at rotation speeds of 18 rpm and 200 rpm, respectively, and the toner was mixed with carrier at an initial blending rate (T/C) of 40%. Under these conditions, a toner concentration (wt %) on the development sleeve 13 was measured while changing the distance in height (Δh). The amount of toner T on the development sleeve 13 was measured by the use of a carbon amount analyzing apparatus (HORIBA, EMIA-110).

Figure 5:
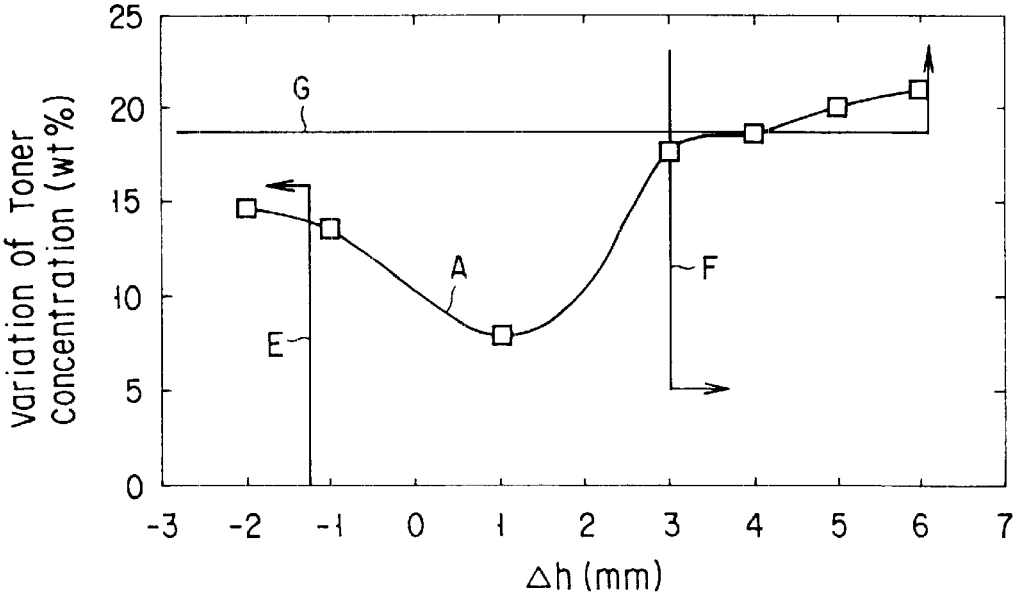
FIG. 5 is a graph showing the correlation between the concentration of a toner on a development sleeve and the difference ~h in height between the top of a toner table and a spoon surface.

As is apparent from FIG. 5, it is demonstrated that the difference in height Δh is desirably set at a value within the range of 0 to 2.5 mm, that is, $0 \leqq \Delta h \leqq 2.5$ mm. When the difference Δh is lower than 0 ($\Delta h<0$), the toner concentration (density) on the development sleeve 13 becomes nonuniform. In particular, in the range lower than −1.2 mm ($\Delta h<-1.2$ mm), the nonuniformity in concentration of the toner T on the development sleeve 13 becomes more significant. As a result, development defects are caused. This phenomenon occurs in the range leftward of line E in FIG. 5.

On the other hand, if the difference Δh exceeds 2.5 mm ($\Delta h>2.5$ mm), toner T is not sufficiently supplied to the development sleeve 13, causing faint streaking. Particularly in the range exceeding 3 mm ($\Delta h>3$ mm), printed letters are too faint to read. This phenomenon occurs in the range rightward of line F in FIG. 5.

The faint streaking also appears when the concentration of toner T on the development sleeve 13 increases. In particular, when the toner has run out, the toner concentration exceeds 18 wt %, with the result that printing cannot be done properly because of faint streaking. This phenomenon occurs in the region above line G in FIG. 5.

In a conventional apparatus, when the agitator arm is horizontal, the spoon surface is higher than the toner shelf. In this case, when toner is supplied from a toner supply auger, a large amount of toner is loaded in the toner hopper, agitated by the agitator, and attached to the development sleeve, temporarily nonuniformly. As a result, every time the toner is supplied to the toner hopper, the concentration of toner on the development sleeve greatly varies.

The mixing ratio of toner to magnetic carrier greatly varies within the range of 17 to 70% in a conventional apparatus, partially to about 80%. However it is demonstrated that the rate is as stable as about 50% in average in the apparatus of the present invention.

According to the present invention, excessive supply of toner and shortage of toner can be prevented. In addition, a developer (carrier and toner) can be securely loaded into the development sleeve and the toner shelf. As a result, the toner can be supplied on the development sleeve uniformly in concentration. Hence, it is possible to obtain stable images having no unevenness, faint streaking and fogging.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image read-out section for reading out an image;

a photosensitive drum for forming an electrostatic latent image corresponding to said image based on image data supplied from the image read-out section;

a vertical transfer passage for transferring a transfer material upward to the photosensitive drum; and a developing unit arranged below the photosensitive drum for depositing toner on the electrostatic latent image formed on the photosensitive drum with the assistance of a small amount of magnetic carrier, wherein said developing unit comprises a housing;

a toner hopper, which is a part of the housing, for containing a toner;

a toner supply source for supplying the toner to the toner hopper;

a magnetic roller positioned above the toner hopper for imparting a magnetic field to the magnetic carrier;

a development sleeve, covering the outer periphery of the magnetic roller, holding the magnetic carrier, allowing the magnetic carrier to adsorb the toner, rotating in the opposite direction to the rotation direction of the magnetic roller, thereby allowing the toner to transfer and adhere onto the electrostatic latent image formed on the photosensitive drum;

a doctor blade arranged a slight distance from the development sleeve for cutting and removing excessively supplied toner from the development sleeve;

an agitator arranged within the toner hopper for agitating and mixing the toner contained in the toner hopper;

a rotation arm arranged in the agitator and rotated about a rotation center lower than a rotation center of the development sleeve;

a spoon having a substantially flat spoon surface at a tip of the rotation arm for scooping up the toner from the toner hopper when the spoon surface comes close to the development sleeve and transferring the toner;

a toner shelf, which is a part of the housing, arranged immediately under the development sleeve for holding the toner transferred by the spoon and for receiving the toner and the magnetic carrier cut and removed by the doctor blade;

a developer returning member, arranged between the doctor blade and the toner hopper, for preventing the toner and magnetic carrier cut and removed by the doctor blade from transferring to the toner hopper, guiding and returning the toner and magnetic carrier to the toner shelf; and a weir, arranged between the toner shelf and the toner hopper, having a top portion which is equal to or higher than the spoon surface in height when the rotation arm is horizontal and which defines a space between the top portion and the developer returning member for passing the toner to be transferred by the spoon, and guiding and returning the toner and magnetic carrier cut and removed when the developer returning member returns the toner to the development sleeve.

2. The apparatus according to claim 1, wherein the top portion of the weir is higher by up to 2.5 mm than the spoon surface when the rotation arm is horizontal.

3. The apparatus according to claim 1, wherein said weir has a front-edge slope smoothly and continuously formed from the top portion to an inner wall surface of the toner hopper and a rear-edge slope smoothly and continuously formed from the top portion to the toner shelf.

4. The apparatus according to claim 3, wherein said front-edge slope is a curved surface having substantially the same curvature as that of the inner wall surface of the toner hopper.

5. The apparatus according to claim 3, wherein said rear-edge slope is a concave surface whose inclination angle becomes gradually reduced toward the toner shelf.

6. The apparatus according to claim 1, wherein the weir is detachably attached to the housing continuously formed with the toner shelf.

7. The apparatus according to claim 1, wherein said spoon is formed by cutting a tip of the rotation arm in half in thickness, and the spoon surface is an exposed tip surface of said spoon cut and removed.

8. The apparatus according to claim 1, wherein said spoon surface is positioned off the rotation center of the rotation arm.

* * * * *